US006736214B2

(12) United States Patent
Hoffman et al.

(10) Patent No.: US 6,736,214 B2
(45) Date of Patent: May 18, 2004

(54) RUNNING TOOL AND WELLBORE COMPONENT ASSEMBLY

(75) Inventors: Corey E. Hoffman, Magnolia, TX (US); Paul Wilson, Houston, TX (US); Jason Ellis, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/819,013

(22) Filed: Mar. 27, 2001

(65) Prior Publication Data

US 2002/0139539 A1 Oct. 3, 2002

(51) Int. Cl.[7] ..... E21B 33/12; E21B 23/06

(52) U.S. Cl. ..... 166/387; 166/374; 166/120; 166/125; 166/182

(58) Field of Search ..... 166/381, 383, 166/382, 386, 387, 374, 98, 120, 23, 125, 135, 181, 182, 193, 194

(56) References Cited

U.S. PATENT DOCUMENTS

| | | | | | |
|---|---|---|---|---|---|
| 3,990,510 | A | * | 11/1976 | Decuir | 166/128 |
| 4,424,864 | A | * | 1/1984 | Logan | 166/133 |
| 4,869,324 | A | * | 9/1989 | Holder | 166/123 |
| 5,143,015 | A | * | 9/1992 | Lubitz et al. | 166/182 |
| 5,297,634 | A | | 3/1994 | Loughlin | 166/387 |
| 5,343,956 | A | * | 9/1994 | Coronado | 166/123 |
| 5,361,834 | A | | 11/1994 | Cox | 166/120 |
| 5,375,662 | A | | 12/1994 | Echols, III et al. | 166/386 |
| 5,411,082 | A | * | 5/1995 | Kennedy | 166/181 |
| 5,577,560 | A | * | 11/1996 | Coronado et al. | 137/138 |
| 6,167,970 | B1 | | 1/2001 | Stout et al. | 166/377 |
| 6,173,786 | B1 | * | 1/2001 | Sampson et al. | 166/123 |

OTHER PUBLICATIONS

PCT International Search Report from International Application No. PCT/GB02/01052, dated Aug. 6, 2002.

* cited by examiner

*Primary Examiner*—David Bagnell
*Assistant Examiner*—Jennifer H Gay
(74) *Attorney, Agent, or Firm*—Moser, Patterson & Sheridan, L.L.P.

(57) ABSTRACT

The invention provides a running tool for a wellbore component. In one aspect, the tool includes a body having a longitudinal bore therethrough with an upper end for connection to a tubular run-in string and a selective attachment assembly for a wellbore component therebelow. A flow directing member is disposed in the bore and is movable between a first and second position. At a predetermined flow rate through the member, the member moves to the second position and directs fluid towards the selective attachment assembly, thereby causing the running tool to become disengaged from the wellbore component after the wellbore component has been actuated and fixed in the wellbore.

24 Claims, 5 Drawing Sheets

RUNNING TOOL AND WELLBORE COMPONENT ASSEMBLY

BACKGROUND OF THE INVENTION

1. Field of the Invention

The present invention relates to running tools and wellbore components for use in a well. More particularly, the invention relates to a running tool for installing a wellbore component in a well. More particularly still, the invention relates to a flow-actuated release mechanism for a running tool.

2. Background of the Related Art

An oil or gas well includes a wellbore extending from the surface of the well to some depth therebelow. Typically, the wellbore is lined with a string of tubular like casing, to strengthen the sides of the borehole and isolate the interior of the casing from the earthen walls therearound. In the completion and operation of wells, downhole components are routinely inserted into the well and removed therefrom for a variety of purposes. For example, in some instances it is necessary to isolate an upper portion of the wellbore from a lower portion and a bridge plug can be inserted into the wellbore to seal the upper and lower areas from each other. In other instances, it is desirable to seal an annular area formed between two co-axial tubulars or between one tubular and an outer wall of the wellbore and a packer is typically inserted into the wellbore to accomplish this purpose.

In each instance, wellbore components are run into the wellbore on a tubular run-in string with a running tool disposed between the lower end of the tubular string and the wellbore component. Once the wellbore component is at a predetermined depth in the well, it is actuated by mechanical or hydraulic means in order to become anchored in place in the wellbore. Hydraulically actuated wellbore components require a source of pressurized fluid from the tubular string thereabove to either actuate slip members fixing the component in the wellbore or to inflate sealing elements to seal an area between the outside of the component and the inner wall of the wellbore therearound. Once actuated, the wellbore components are separated from the running tool, typically through the use of some temporary mechanical connection which is caused to fail by a certain mechanical or hydraulic force applied thereto. After the shearable connection has failed, the running tool and the tubular string can be removed from the wellbore leaving the actuated wellbore component therein.

Presently, more and more wellbore components are inserted into wells using a tubular string made up of coiled tubing. Coiled tubing, because it is light, flexible, compact and easily transported is popular for delivering wellbore components. For example, rather than assembling a tubular string with sequential joints of rigid pipe, coiled tubing can be delivered to the well site on a reel and simply unwound into the wellbore to the desired length. Additionally, when a wellbore component must be inserted into a live well, coiled tubing, with its constant outer diameter, is easier to use with pressure retaining components like stripers than sequential tubular sections having enlarged threaded connectors therebetween.

In spite of the advantages related to coiled tubing run-in strings for wellbore components, there are also disadvantages. For example, most wellbore components run into a well on coiled tubing are designed to be actuated with pressurized fluid delivered through the coiled tubing. Subsequently, these same components are designed to be disconnected from running tools by shearing a shearable connection between the running tool and the wellbore component. Coiled tubing, because it is relatively thin-walled, can expand in diameter when pressurized fluid is present in its interior. When setting a wellbore component, the pressurized fluid delivered through the coiled tubing adequate to set the component can also be adequate to expand the coiled tubing slightly resulting in a shortening of the coiled tubing string. This shortening can produce an upwards force which causes the shearable connection between the running tool and the component to fail, thereby disconnecting the running tool from the component before the component is completely set in the wellbore. There are other problems related to shearable connections between running tools and wellbore components that are present no matter what type of tubular run-in string is utilized. For example, a shearable connection which has been designed based upon faulty calculations can fail and dislodge the running tool from the wellbore component prematurely. Additionally, some shearable connections are designed whereby the shear pins are partially exposed to fluid pressure used to set the wellbore component. The result can be a shearable connection that fails prematurely.

There is a need therefore, for a wellbore component assembly which can be more easily inserted into a wellbore. There is a further need for a running tool for a wellbore component which does not rely upon physical force to become disconnected from the wellbore component. There is yet a further need for a running tool for a wellbore component having a detachment mechanism that is flow-actuated rather than actuated with physical force. There is yet a further need for a wellbore component assembly including a running tool which can be run into a well on a tubular string of coiled tubing. There is yet a further need for a running tool having a release mechanism that will not release prior to the setting of the wellbore component in the wellbore.

SUMMARY OF THE INVENTION

The invention provides a running tool for a wellbore component. In one aspect, the tool includes a body having a longitudinal bore therethrough with connection means at an upper end for connection to a tubular run-in string and a selective attachment assembly for a wellbore component therebelow. A flow directing member is disposed in the bore and is movable between a first and second position. At a predetermined flow rate through the member, the member moves to the second position and directs fluid towards the selective attachment assembly, thereby causing the running tool to become disengaged from the wellbore component after the wellbore component has been actuated and fixed in the wellbore.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
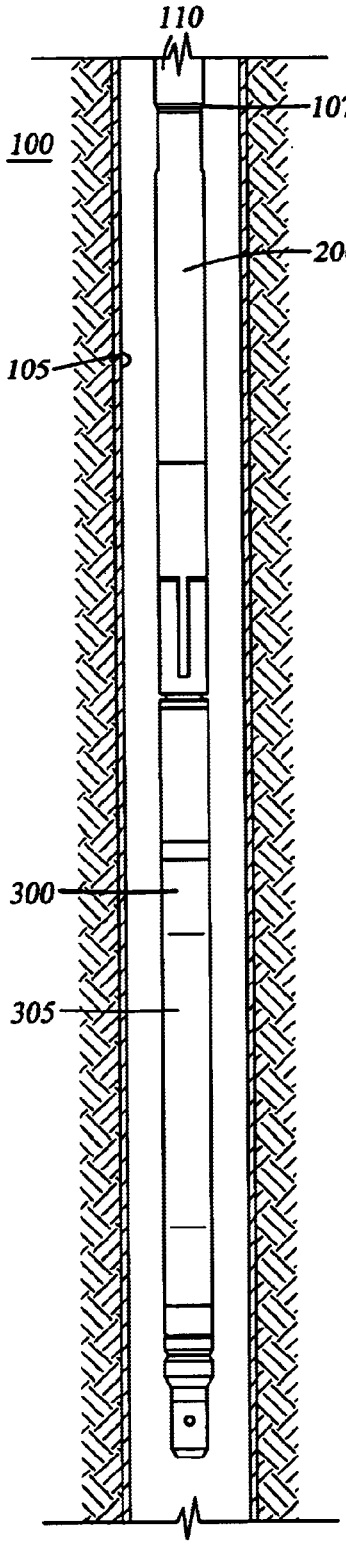
FIG. 1 is a section view of the running tool and wellbore component assembly of the present invention disposed in a cased wellbore.

FIG. 1 is a section view of the running tool and wellbore component assembly 100 of the present invention disposed in a cased wellbore 105. In the embodiment shown in FIG. 1, the assembly 100 includes a running tool 200 with a bridge plug 300 disposed at the end thereof. The bridge plug includes an inflatable element 305. While the wellbore component shown in the Figures and discussed herein is a bridge plug, it will be understood that the assembly could include a packer or any other downhole component designed to be transported into a wellbore and anchored therein. At an upper end, the assembly is attached with a threaded connection 107 to a run-in string 110. In one aspect of the invention, the assembly 100 is run into the well on run-in string of coiled tubing. Typically, other components (not shown) like a double flapper valve, tubing end locator and emergency disconnect would be disposed between the running tool 200 and the coiled tubing string 110. The running tool 200 includes a longitudinal bore therethrough providing a path for pressurized fluid between the coiled tubing string 110 and the bridge plug 300 as will be described herein.

Figure 2:
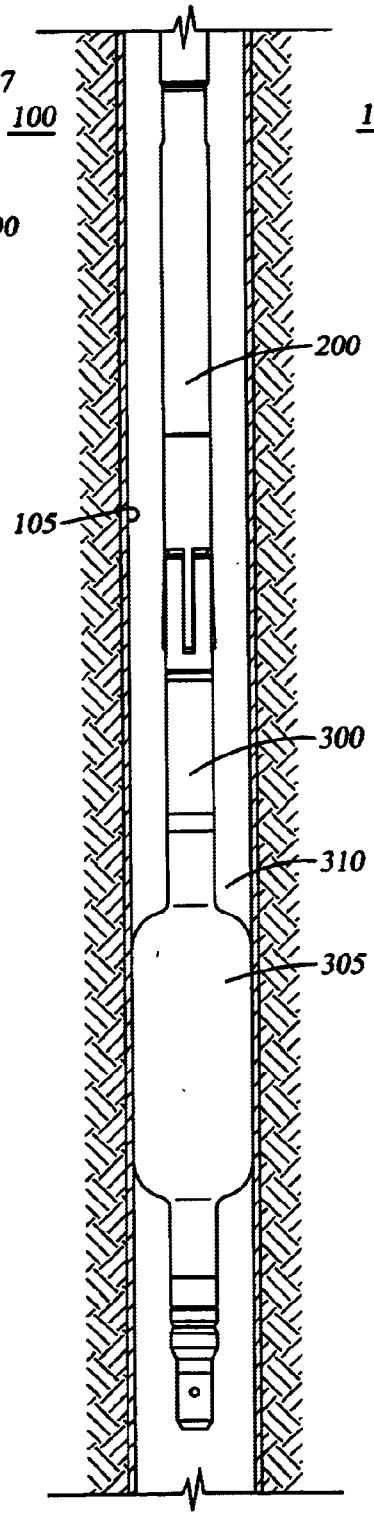
FIG. 2 is a section view of the assembly of FIG. 1 with an inflatable element of the wellbore component actuated against the side of the wellbore.

FIG. 2 is a section view of the assembly 100 of FIG. 1 with the inflatable element 305 inflated against the interior of the wellbore 105. The inflatable element 305 is actuated with pressurized fluid from the coiled tubing string 110 and serves to seal an annular area 310 formed between the inside surface of the wellbore 105 and the exterior of the bridge plug 300. The inflatable element 305 may have any number of configurations on the outside thereof to effectively seal the annulus 310. For example, the inflatable element may include grooves, ridges, indentations or protrusions designed to allow the member 305 to conform to variations in the shape of the interior of wellbore casing (not shown). Alternatively, the inflatable member 305 can seal an annular area created by a non-lined borehole. The inflatable member 305 is typically fabricated from a thermoplastic, an elastomer, or a combination thereof.

Figure 3:
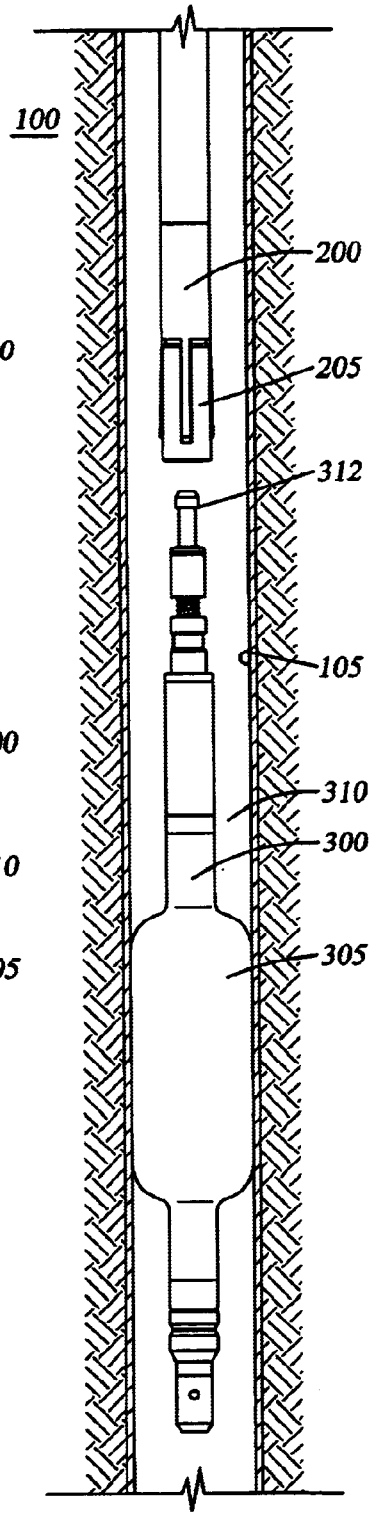
FIG. 3 is a section view of the assembly illustrating the running tool dislodged from the wellbore component.

FIG. 3 is a section view of the assembly illustrating the running tool 200 dislodged from the actuated bridge plug 300 therebelow. A collet assembly 205 disposed on the running tool 200 has been disconnected from the bridge plug 300. In this manner, the bridge plug 300 with its inflatable element 305 is left in the wellbore while the running tool 200 and coiled tubing run-in string are removed. A fish neck 312 formed at the upper end of the bridge plug 300 provides a means for retrieving the bridge plug 300 at a later time. A shearable connection (not shown) fixes the fish neck 312 in the interior of the bridge plug and is caused to fail in order to deflate the inflatable element 305 and remove the bridge plug 300 from the wellbore 105.

Figure 4:
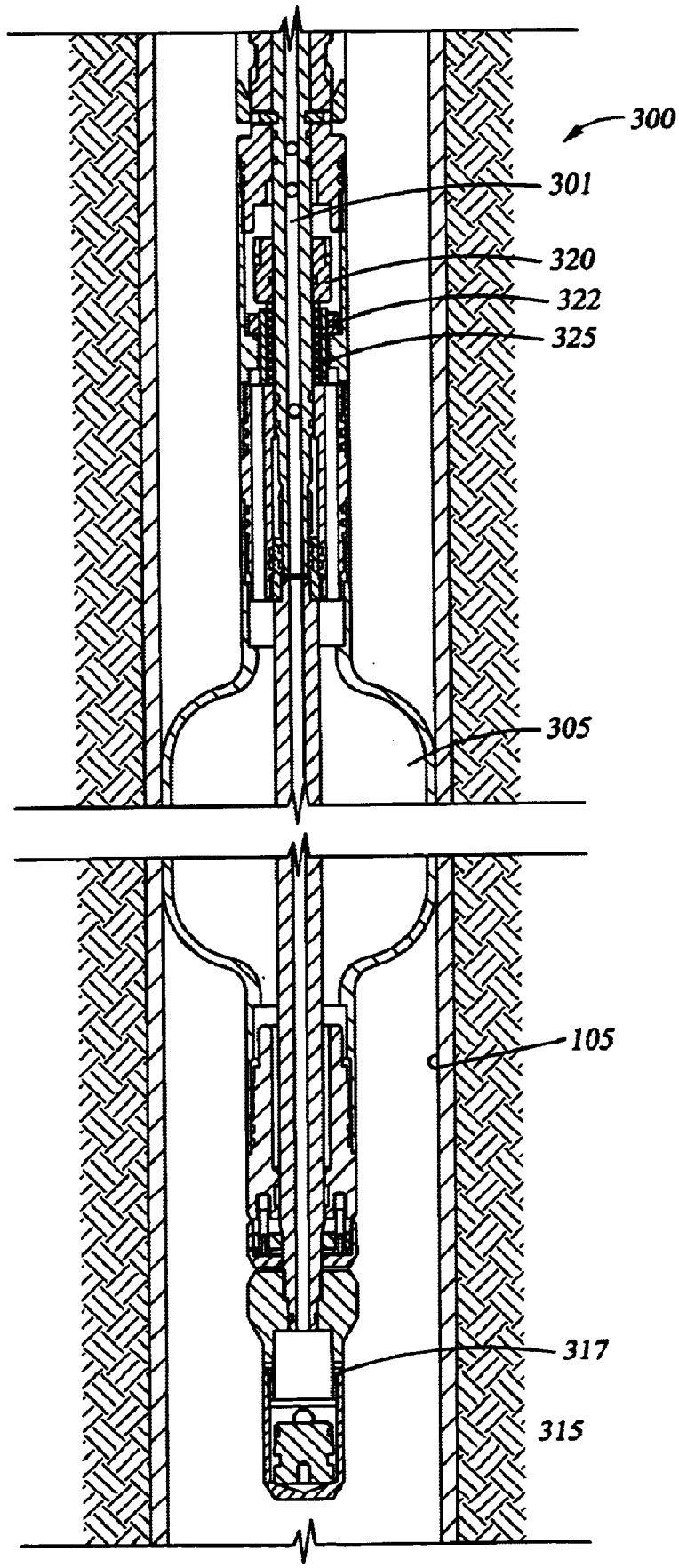
FIG. 4 is a section view of a portion of the wellbore component illustrating the actuation of the component in the wellbore.

FIG. 4 is a section view of a portion of the bridge plug 300 illustrating the actuation means to inflate the inflatable member 305. Disposed in the bridge plug and co-axially disposed around a central bore of the plug is a valve 320 that selectively permits fluid communication between central bore 301 of the bridge plug 300 and inflatable member 305. Initially, valve 320 is held in a closed position by a shearable connection 322 as well as a spring member 325 and is designed to open with a predetermined pressure that is sufficient to overcome the shearable connection 322 and the spring member 325. The predetermined pressure is applied to a column of fluid in the coiled tubing run-in string 110 that extends through the running tool 200 and the bridge plug 300. In FIG. 4, the valve 320 is shown in the open position with the shearable connection 322 having failed and the inflatable member 305 in fluid communication with fluid in the central bore 301 of the bridge plug 300. The central bore 301 is initially blocked at a lower end by a plug 315 which is held in a first position within the interior of the bridge plug by a separate shearable connection 317. In FIG. 4, the plug 315 is shown in a second position after the shearable connection 317 has failed and the plug 315 has moved downward to permit fluid to flow out the lower end of the bridge plug 300.

Figure 5:
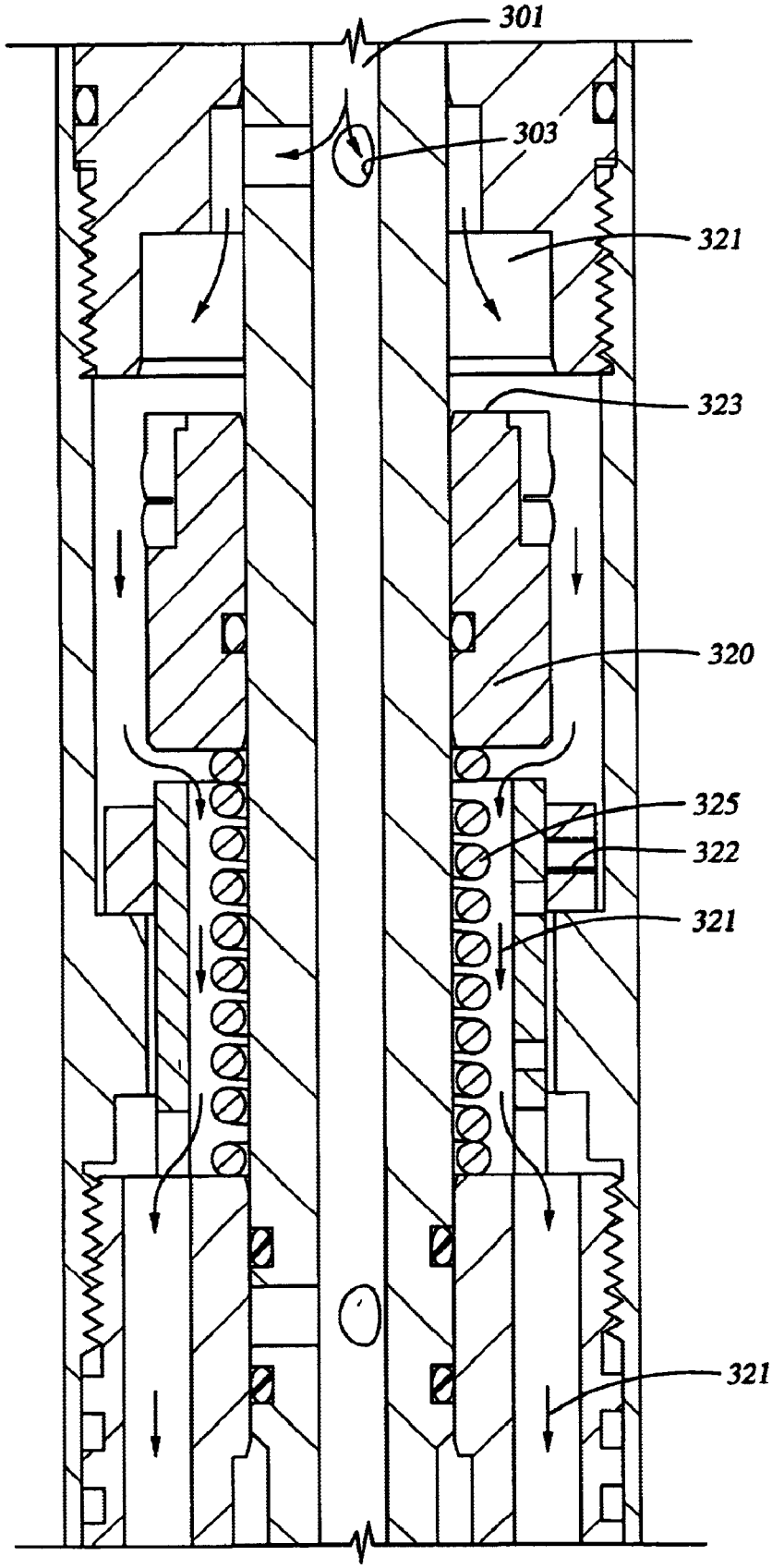
FIG. 5 is an enlarged section view of the components shown in FIG. 4.

FIG. 5 is an enlarged section view showing the valve 320 and including arrows 321 illustrating path of fluid from the central bore 301 of the bridge plug to the inflatable member therebelow. Initially, pressurized fluid acts upon an upper surface 323 of the annularly shaped valve 320 until the shearable connection 322 holding the valve 320 in a first position fails. Thereafter, the fluid pressure moves the valve against spring member 325 as illustrated in FIG. 5. As depicted by the arrows 321, the fluid passes from the central bore 301 of the bridge plug through apertures 303 and follows a path around the outside of the valve 320 and the spring member 325 to reach the inflatable element 305 therebelow.

The sequence of events required to anchor the bridge plug 300 are as follows: The assembly 100 is run into the well to a predetermined depth where the bridge plug 300 will be anchored in the wellbore 105. A first pressure is thereafter applied to the fluid column in the assembly 100 until the shearable connection 322 fixing the valve 320 in the plug fails, permitting the valve to move to an open position and exposing the inflatable member 305 to pressurized fluid. As the inflated pressure of the inflatable member 305 is reached, the shearable connection 317 retaining the plug 315 at the lower end of the bridge plug 300 in the first position fails and the plug falls to a second position, thereby permitting fluid to pass through the bridge plug 300 and into the wellbore 105 therebelow. Typically, the pressure required to inflate the inflatable member 305 to the desired pressure and the pressure required to break the shearable connection 317 holding the plug 315 in its first position will be substantially the same, and both will be higher than the pressure necessary to cause shearable connection 322 to fail. This ensures that the inflatable member becomes fully inflated before the plug at the bottom of the bridge plug becomes dislodged. As the plug 315 is dislocated and fluid passes into the wellbore 105, the spring loaded valve 320 returns to its first position, thereby closing the fluid path to the inflatable member and preventing fluid from escaping from the inflatable member 305. At this point, the bridge plug 300 is anchored and set in the wellbore 105.

Figure 6:
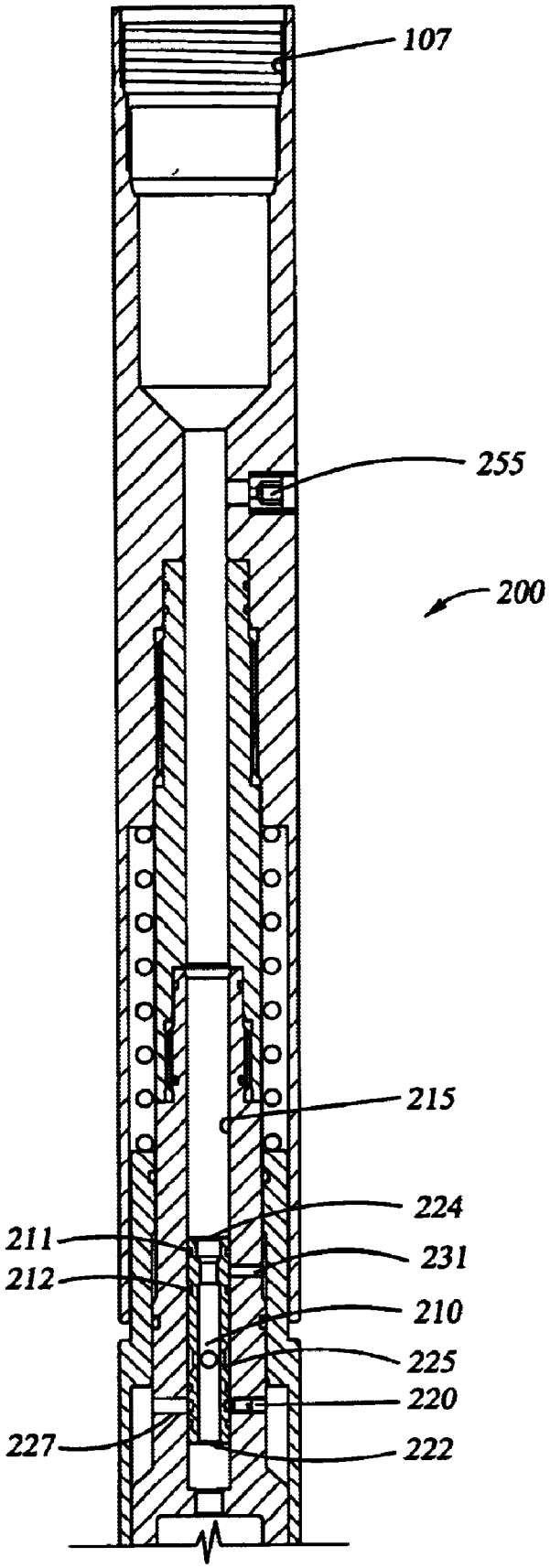
FIG. 6 a section view of the running tool depicting a flow actuated sleeve in a longitudinal bore thereof.

FIG. 6 is a section view of the running tool 200. Connection means 102 provides a means for connection to the coiled tubing running string 110 at an upper end of the tool 200. An orifice 255 in the circle of the tool provides fluid communication between the outside of the tool and the bore 215 for pressure equalization during run-in. Disposed in the bore 215 of the tool 200 is a flow-actuated sleeve 210 shown in a first position. The sleeve 210 is held in the first position by a shearable connection 220 which axially fixes the sleeve 210 in the bore 215.

The flow-actuated sleeve 210 is constructed and arranged to permit the flow of fluid through its central bore while in the first position, but to divert the flow of fluid after shifting to a second position. As illustrated in FIG. 6, a port 231 formed in a wall of the running tool 200 is initially blocked to the flow of fluid by the sleeve 210 which is equipped with seals 211, 212. Additionally, apertures 225 formed in a well of the sleeve are initially misaligned with mating ports 227 formed in the well of the running tool 200.

The flow-actuated sleeve 210 remains in the first position until fluid flow across a piston surface 224 formed at the upper end of the sleeve is adequate to overcome the shearable connection 220 retaining the sleeve in the first position. The design of the bridge plug 300 prevents an adequate amount of fluid flow prior to the inflation of the inflatable member 305.

Figure 7:
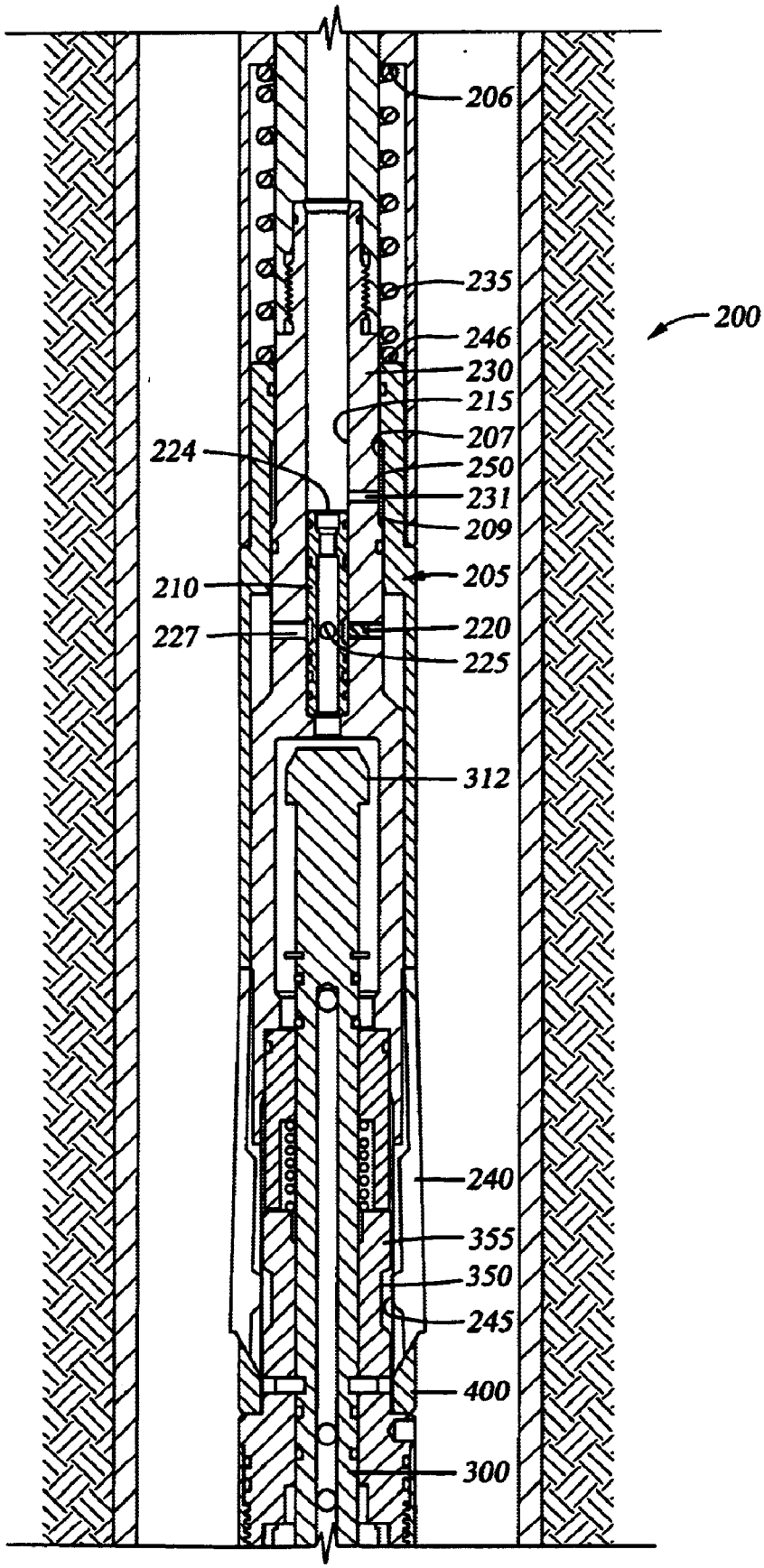
FIG. 7 is a section view of the assembly running tool showing the flow-actuated sleeve in a second position and collet fingers dislodging from the wellbore component.

FIG. 7 is a section view of the running tool 200 showing the flow actuated sleeve 210 in the second position within the bore 215 of the tool 200. In order for the sleeve to assume this position, the bridge plug 300 must be anchored with the inflatable member 305 inflated and the plug 315 at the lower end of the bridge plug 300 dislodged, thereby permitting fluid to be circulated through the apparatus 100.

With the sleeve 210 in the second position, fluid communication is permitted between the bore 215 of the tool and the collet assembly 205 as will be further described below. Also in FIG. 7, apertures 225 formed in the wall of the sleeve 210 are aligned with mating ports 227 formed in the wall of the running tool 200. The apertures 225 and ports 227, when aligned, create a path for fluid to the outside of the tool 200 in case there should be some obstruction below the bridge plug 300 in the wellbore. This alternative fluid path permits circulation of fluid, and disengagement of the running tool 200 from the bridge plug 300, even if the wellbore below the bridge plug is blocked.

In addition to operating the flow actuated sleeve 210 in the forgoing manner, the sleeve can also be moved from the first to the second position by simple application of pressure if it becomes necessary to quickly and safely disconnect the running tool 200 from the bridge plug 300 without the use of flow actuated means. For example, by dropping a ball or other substantially spherical-shaped object into the wellbore to fall within the coiled tubing string 110, the object can be made to land on the surface of the sleeve 210, blocking fluid flow therethrough. Thereafter, pressure applied to a column of fluid in the coiled tubing string 110 will be transmitted directly to the sleeve 210, overcoming the shearable connection 220 holding the sleeve 210 in the first position. After the sleeve and ball move to the second position, fluid communication is established between the bore 215 of the tool 200 and the collet assembly 205 therearound.

Visible in FIG. 7 is collet assembly 205 disposed about the body 230 of the running tool 200. The collet assembly 205 is slidingly disposed about the body and preferably biased towards the coiled tubing string thereabove by a spring 235 also disposed about the body of the tool 200. The spring 235 acts at a first end against a shoulder 206 formed on body 205 and at a second end against an upper end 246 of the collet assembly 205. The collet assembly 205 includes a plurality of equally spaced fingers 240 attached at a lower end thereof and flexible about the bridge plug 300. Each of the fingers 240 include an inwardly directed formation 245 which is constructed and arranged to be retained in a groove 350 formed around the body 355 of the bridge plug 300. Additionally, a retaining member 400 disposed about the body 355 of the bridge plug 300 retains the fingers 240 in a closed position within groove 350.

The collet assembly 205 is disposed about the body 230 of the running tool whereby the assembly 205 moves axially with respect to the body 230. The collet assembly 205 is designed with a chamber 250 formed between an interior surface 207 of the collet assembly 205 and an outer surface 209 of the body 230 of the running tool 200. The chamber 250 is in fluid communication with port 231 when the flow actuated sleeve 210 is in the second position. Fluid passing into the chamber 250 causes the collet assembly 205 to move axially in relation to the running tool 200, against spring member 235. In FIG. 7, the collet assembly is depicted having moved against the spring member 235 and the fingers 240 of the collet assembly 205 are partially released from the groove 350 and the retaining member 400. With the fingers 240 disengaged from the bridge plug 300, the run-in string 110 and running tool 200, may be removed from the wellbore 105 leaving the anchored bridge plug 300 in place. An additional spring-loaded flow control valve which is normally in the opened position is disposed about the fish neck 312 and is utilized to seal the bore through the body and complete the setting of the bridge plug in a wellbore as the running tool is removed therefrom.

As the forgoing demonstrates, the invention includes an effective way to release a wellbore component from a running tool. The release mechanism, because it is flow actuated is less susceptible to premature release than conventional designs and the release does not take place until the wellbore component is set in the wellbore.

While foregoing is directed to the preferred embodiment of the present invention, other and further embodiments of the invention may be devised without departing from the basic scope thereof, and the scope thereof is determined by the claims that follow.

What is claimed is:

1. A running tool for a detachable wellbore component, the tool comprising:

a first end for connection to a tubular run-in string;

a longitudinal bore permitting the flow of fluid to the tool;

an attachment assembly housed on the tool and selectively attachable to the wellbore component;

a release assembly having a plurality of fingers configured to retain the wellbore component; and a flow-actuated, fluid diverter for diverting fluid to the release assembly to release the tool from the wellbore component as the fingers move radially outward away from a central axis of the wellbore component and the release assembly moves upwardly and axially relative to the tool.

2. The tool of claim 1, wherein fluid flows through the tool.

3. The tool of claim 1, wherein the diverter is disposed in the bore of the tool.

4. The running tool of claim 3, wherein the diverter is moveable between a first and an actuated position within the bore.

5. The running tool of claim 1, wherein the release assembly is a collet assembly disposed on the running tool and connectable to the component.

6. The running tool of claim 4, wherein the diverter is retained in the first position by a temporary mechanical connection.

7. The running tool of claim 6, wherein the diverter is a sleeve disposed in the bore.

8. The running tool of claim 7, wherein the sleeve includes a piston surface formed at an upper end thereof, the piston surface acted upon by the flow of fluid passing through the sleeve.

9. The tool of claim 8, wherein the flow of fluid creates a pressure force on the piston surface of the sleeve.

10. The running tool of claim 9, wherein the temporary mechanical connection is overcome when a predetermined pressure force is reached on the piston surface.

11. The running tool of claim 9, wherein the temporary mechanical connection is overcome by an object placed at the upper end of the sleeve, preventing fluid from passing therethrough.

12. The running tool of claim 1, wherein the wellbore component is a bridge plug.

13. The running tool of claim 1, wherein the wellbore component is a packer.

14. The running tool of claim 1, wherein the wellbore component is a cement retainer.

15. The running tool of claim 1, wherein the wellbore component is a straddle.

16. The running tool of claim 1, wherein the wellbore component is to be inserted into a wellbore utilizing the tool and then left therein.

17. The running tool of claim 1, wherein the tubular run-in string is coiled tubing.

18. A method of inserting a wellbore component into a wellbore, comprising:

a) running the wellbore component into the wellbore on a tubular string to a predetermined depth with a running tool disposed between the component and the tubular string;

b) causing the component to become actuated in the wellbore and fixed therein and thereafter;

c) utilizing a predetermined fluid flow rate to cause a sleeve in a bore of the running tool to move between a first and second position, thereby directing fluid flow to a collet assembly; and moving the collet assembly axially relative to the running tool to release the running tool from the component.

19. The method of claim 18, wherein the tubular string is coiled tubing.

20. A running tool for a detachable wellbore component, the tool comprising:

a first end for connection to a coiled tubing run-in string;

a longitudinal bore permitting the flow of fluid through the tool;

a flow-directing sleeve disposed in the bore and movable between a first and a second position in the bore, the sleeve directing fluid flow radially outward of the bore when the sleeve is in the second position;

a piston surface formed at an upper end of the sleeve, the piston surface causing the sleeve to move to the second position when a predetermined fluid flow rate is applied thereto; and a collet assembly disposed radially outward of the bore, the collet assembly selectively attachable to the wellbore component and constructed and arranged to disengage with the wellbore component by moving axially with respect to the tool when the sleeve moves to the second position.

21. An assembly for placing a wellbore component in a wellbore comprising:

a tubular run-in string; and a running tool disposed on the run-in string, wherein the running tool is selectively attachable to a wellbore component and comprises:

a flow actuated mechanism that, when shifted into an actuated position, directs fluid flow radially outward, wherein the flow actuated mechanism is actuatable only upon the flow of fluid through a bore formed within the running tool and the wellbore component; and a release mechanism that, in response to the flow actuated mechanism being shifted into the actuated position, moves axially in relation to the running tool to release the running tool from the wellbore component.

22. A running tool for a detachable wellbore component, the tool comprising:

a first end for connection to a tubular run-in string;

a longitudinal bore permitting the flow of fluid to the tool;

an attachment assembly housed on the tool and selectively attachable to the wellbore component;

a release assembly configured to retain the wellbore component; and a flow-actuated, fluid diverter for diverting fluid to the release assembly to cause the release assembly to move upward while the tool remains stationary, thereby releasing the tool from the wellbore component.

23. The tool of claim 22, wherein the release assembly is configured to release the tool from the wellbore component by moving radially outward in relation to the tool.

24. The tool of claim 22, wherein the release assembly is configured to release the tool from the wellbore component by moving axially with respect to the tubular run-in string.

* * * * *